US010385470B2

(12) United States Patent
Danzebrink et al.

(10) Patent No.: US 10,385,470 B2
(45) Date of Patent: Aug. 20, 2019

(54) TREATMENT OF AN ANODICALLY OXIDIZED SURFACE

(71) Applicant: Nanogate AG, Quierschied-Göttelborn (DE)

(72) Inventors: Rolf Danzebrink, Ingbert (DE); Anne Danzebrink, Ingbert (DE); Tanja Geyer, Schönenberg-Kübelberg (DE); Markus Koch, Pirmasens (DE)

(73) Assignee: Nanogate AG (DE)

( * ) Notice: Subject to any disclaimer, the term of this patent is extended or adjusted under 35 U.S.C. 154(b) by 27 days.

(21) Appl. No.: 14/386,686

(22) PCT Filed: Mar. 21, 2013

(86) PCT No.: PCT/EP2013/055913
§ 371 (c)(1),
(2) Date: Sep. 19, 2014

(87) PCT Pub. No.: WO2013/139899
PCT Pub. Date: Sep. 26, 2013

(65) Prior Publication Data

US 2015/0034487 A1 Feb. 5, 2015

(30) Foreign Application Priority Data

Mar. 22, 2012 (DE) ..... 10 2012 204 636

(51) Int. Cl.

| | |
|---|---|
| ***C25D 11/18*** | (2006.01) |
| ***C25D 11/24*** | (2006.01) |
| ***C25D 11/16*** | (2006.01) |
| ***C23C 18/12*** | (2006.01) |

(52) U.S. Cl.
CPC ..... *C25D 11/246* (2013.01); *C23C 18/122* (2013.01); *C23C 18/1245* (2013.01); *C23C 18/1254* (2013.01); *C25D 11/18* (2013.01); *C25D 11/24* (2013.01); *C25D 11/16* (2013.01)

(58) Field of Classification Search
CPC ..... C25D 11/246; C25D 11/18; C25D 9/02; C25D 11/24
USPC ..... 205/201–204, 229
See application file for complete search history.

(56) References Cited

U.S. PATENT DOCUMENTS

| | | | | |
|---|---|---|---|---|
| 3,450,606 | A * | 6/1969 | Darrow | C25D 11/14 205/121 |
| 4,288,299 | A * | 9/1981 | Carter | C25D 11/246 148/276 |
| 5,891,269 | A * | 4/1999 | Koerner | C25D 11/18 148/272 |
| 6,059,897 | A * | 5/2000 | Koerner | C25D 11/246 148/272 |
| 2006/0219568 | A1* | 10/2006 | Hotta | C25D 11/045 205/173 |
| 2007/0134128 | A1* | 6/2007 | Korlach | G01N 21/0303 422/400 |
| 2009/0202845 | A1 | 8/2009 | Hodges | |
| 2016/0082702 | A1* | 3/2016 | Takada | B32B 15/08 428/341 |

FOREIGN PATENT DOCUMENTS

| | | | | |
|---|---|---|---|---|
| EP | 1306467 | A1 | 5/2003 | |
| EP | 1407935 | A1 | 4/2004 | |
| EP | 1780313 | A2 | 7/2006 | |
| EP | 2328183 | A1 | 6/2011 | |
| JP | 60-179475 | A | 9/1985 | |
| JP | 06-316787 | A | 11/1994 | |
| JP | 2002-069696 | A | 3/2002 | |
| JP | WO 2011001862 | A1 * | 1/2011 | C09D 5/443 |
| WO | 2009/068168 | A1 | 6/2009 | |
| WO | 2011/020556 | A2 | 2/2011 | |

OTHER PUBLICATIONS

English translation of WO2011/001862 from CN102713021.*
http://aluminumsurface.blogspot.com/2009/04/why-sealing-process-is-so-innportant.html (Year: 2009).*
May 13, 2014 International Search Report issued in International Application No. PCT/EP2013/055913.

* cited by examiner

*Primary Examiner* — Brian W Cohen
(74) *Attorney, Agent, or Firm* — Seth L. Hudson; Clements Bernard Walker, PLLC

(57) ABSTRACT

The invention relates to a process for treating an anodically oxidized surface of aluminum or an aluminum alloy by means of a wet chemical process, wherein the surface of aluminum or the aluminum alloy is pretreated, anodically oxidized, flushed and partially subjected to hot compacting. The present invention also relates to a corresponding aluminum surface obtainable, in particular, with the aid of the process according to the invention.

8 Claims, No Drawings

TREATMENT OF AN ANODICALLY OXIDIZED SURFACE

FIELD OF THE INVENTION

The invention relates to a process for treating an anodically oxidized surface of aluminum or an aluminum alloy by means of a wet chemical process, wherein the surface of aluminum or of the aluminum alloy is pretreated, anodically oxidized, rinsed and hot-sealed.

The present invention further relates to a corresponding aluminum surface obtainable, in particular, by means of the process according to the invention.

The term "aluminum" as used hereinafter also includes aluminum alloys according to the invention. Aluminum alloys are known to be produced by alloying aluminum with other metals, for example, manganese, magnesium, copper, silicon, nickel, zinc and beryllium. In most cases, Al 99.5 (pure aluminum) serves as the starting material for the alloys.

BACKGROUND OF THE INVENTION

EP 1 407 935 A1 and the related patent family describes a process for applying a thin ceramic coating material to a surface of a motor vehicle assembling element made of aluminum, which is to be coated, wherein said aluminum is anodized before being coated, and a roughness of the surface to be coated for adhesion of the coating material is achieved by said anodizing process. Then, said thin ceramic coating material, which exclusively consists of inorganic components, is applied by means of an electrostatic application method or by means of a wet-chemical application method at an almost constant layer thickness as a coating with a pore-free and closed surface.

This technical teaching is based on the object of improving the quality of known thin ceramic coatings. In particular, a process is to be provided that enables a cost efficient production of high quality thin ceramic coatings. In addition, parts or objects that have a high quality thin ceramic coating and can be produced cost efficiently are to be created. It is further essential that the thin ceramic coating exclusively consists of inorganic components. The description of the process ends with the application of the coating to the aluminum surface.

WO 2009/068168 A2 and the related patent family describe a component made of aluminum and/or an aluminum alloy, particularly a decorative or functional part, having very high corrosion resistance, and to a method for the production thereof. The conversion layer is to be sealed in the course of at least 3 min/μm of layer thickness. The high corrosion resistance, particularly high alkali resistance, is to be achieved in that the surface of the component comprises an oxide layer created evenly by anodization and a cover layer sealing and evenly covering the porous oxide layer. The cover layer is created by an oxide layer hydrate compound sealing the pores of the oxide layer and by an additional inclusion of glass-like substances and application thereof to the oxide layer at the same time. A compound of one or more alkali silicates is proposed as said glass-like substances. Alternatively, the cover layer may also comprise exclusively aluminum oxide and/or aluminum hydrates and/or aluminum oxide hydrates and/or alkali silicates and/or alumosilicates.

WO 2011/020556 A1 and the related patent family also describe an aluminum or aluminum alloy formed and/or structural part, and a process for protecting its surface. An anti-corrosion layer obtained from a sol-gel system is applied directly to the surface of aluminum or aluminum alloy, without anodized layer, which is to be produced by integrated hardening or drying during an optimized process sequence, that is, a shortened process sequence.

An anodized layer is also omitted in EP 2 328 183 A1 and the related patent family. In a substrate with a metal foil for preparing photovoltaic cells, a first side of the metal foil is provided for arranging a photovoltaic-absorber layer. In order to improve the chemical resistance and the corrosion resistance at elevated temperature, a protective layer of a silicon-based sol-gel paint is arranged on the second side of the metal foil.

EP 1 306 467 A1 describes a thermoplastic resin-coated aluminum plate, wherein the aluminum plate bears a semi-non-porous conversion layer prepared by a pretreatment. In [0012], the term "semi-non-porous" is characterized in that the ratio (called porosity) of the free areas of pores present in the conversion layer on the surface of the aluminum plate to the total area of the anodized film is 30% or less. If the porosity is 5% or less, the film is called practically non-porous. The thickness of this layer can be within a range of from 50 to 3000 Å (5 to 300 nm). According to [0031], the conversion layer is coated with a polymer containing silicon. This polymer has corresponding thermoplastic properties and is prepared from various silanes or siloxanes as precursors.

JP 06-316787 A describes the anodization of an aluminum surface by immersing it into a water-containing alcoholic HCl solution containing a small amount (<2% by weight) of an alkoxysilane to obtain a fully sealed conversion layer.

JP 60-179475 A describes the formation of a conversion layer on aluminum surfaces by applying an inorganic paint containing a high organosilicon condensate, which lacks silanol groups, however. It is applied to an aluminum surface anodized in the usual way.

EP 1 780 313 A2 relates to an article, comprising a substrate having a surface of aluminum or an aluminum alloy, a sealing anodic coating layer overlying at least part of the substrate, and a layer of a silicon-containing polymer overlying the anodic sealing layer. According to the description, the coating is performed directly with the polymer, or with an aqueous solution of a silane without performing a cold or hot sealing directly following the preparation of the conversion layer. In this way, this is also shown in Example 1. However, reference is made to the military specification of the U.S. Department of Defense (MIL-A-8625F), according to which a complete sealing for at least 15 minutes (p. 7, items 3.8.1 and 3.8.1.1) is prescribed independently of layer thickness, however. The applied polymer coating is to be dried at a temperature of from 10 to 100° C.

In the motor vehicle field, there are a number of trim parts having surfaces of aluminum or aluminum alloys. Thus, WO 2009/068168 describes that the decorative surfaces are obtained by polishing or electropolishing. the most frequently used aluminum materials that are employed in the motor vehicle field are also known from this document. In addition to pure aluminum, these include aluminum alloys with the material symbols Al 99.85MgSi or AlMg0.5 or 0.8. The automobile manufacturers expect an alkali resistance of at least 11.5, and even up to 13.5 for particular components.

Appropriate alkali resistances and other properties of aluminum surfaces are prescribed, among others, by the manufacturer Volkswagen AG in their internal, but publicly available, Component Specification TL182 (issue 2011 January), "Inorganic Protective Layer on Aluminum Parts".

SUMMARY OF THE INVENTION

The object of the present invention is to provide another process for preparing components of aluminum or an aluminum alloy having improved corrosion resistance, especially reaching alkali resistance up to pH values of 13.5, without adversely affecting the remaining positive properties of an anodized aluminum surface, such as corrosion resistance towards salt and acid loads, weathering and scratch resistance.

The solution to the above object consists in an essential process step of hot sealing an anodically oxidized surface of aluminum or an aluminum alloy. After a per se conventional anodizing process comprising pretreating, anodic oxidation and rinsing steps, the anodically oxidized surface is only partially hot-sealed, so that a high porosity of the surface is maintained. Subsequently, this surface is contacted with a material containing an organosilicon network former, followed by curing at a temperature of up to 250° C. Too high a curing temperature may cause discoloring of or detaching from the aluminum surface, which is not accepted by the purchaser of the component with the aluminum or the aluminum alloy.

DESCRIPTION OF THE PREFERRED EMBODIMENTS

In a first embodiment, the invention relates to a process for treating an anodically oxidized surface of aluminum or an aluminum alloy by means of a wet chemical process, wherein the surface of aluminum or of an aluminum alloy is pretreated, anodically oxidized, rinsed and hot-sealed, characterized in that partial hot sealing is performed in water at a temperature of up to 100° C. in the course of up to 30 s/μm of layer thickness of the conversion layer, followed by contacting a material containing an organosilicon network former with the partially hot-sealed surface, followed by curing at a temperature of up to 250° C.

Components prepared according to the invention were subjected to a salt spray test according to DIN EN ISO 9227. This is a 480 h neutral salt spray (NSS) test according to DIN EN ISO 9227 NSS, and a 48 h CASS test according to DIN EN ISO 9227 CASS. The specification of the component includes that no optical change from the delivered state must be visible, and detachment of the protective layer and corrosion on class A or class B surfaces of the component are not accepted either. The components obtainable according to the invention showed no optical change, in particular, no white discoloration, from the delivered state.

In another acid-heat-alkali resistance (AHA resistance) test, alkali resistance was tested. The sequence of this method is immersion of the component for 10 minutes into an aqueous solution with a pH value of 1. This is followed by rinsing with water and drying. After heat storage for one hour at 40° C., the component is immersed for 10 min into a solution at pH 13.5. After subsequent rinsing with water and drying, no optical change from the delivered state could be noted.

In the so-called convened AMTEC-Kistler and acid-heat-alkali (AHA) resistance test, the mechanical strength of the component is measured. The coatings obtainable according to the invention did not detach.

Also, in the temperature resistance test performed in the course of 24 h at 160° C., no cracks and no optical changes showed as compared to the delivered state, even though the material applied to the anodized aluminum or aluminum alloy contained organic components.

The light and weather resistance tests usual in the motor vehicle field, such as the Florida test or Kalahari test, could be passed by means of the present invention.

In addition, components prepared according to the invention passed a sterilization process of at least 500 cycles as usual in medical engineering. In each cycle of such a sterilization process, the component was at first cleaned with water at 40 to 60° C. for at least 5 minutes. Suitable pH-neutral or alkaline products, for example, with pH<11.5, may also be employed as cleaners. The sterilization was subsequently performed with moist heat under fractionated vacuum (steam sterilization, DIN EN ISO 17665-1) at 134° C., under a pressure of 3 bar, with a holding time of at least 5 minutes and a drying time of at least 15 minutes per cycle.

Below, a typical anodizing process is described, which is also performed according to the present invention, for example, using a standard alloy, such as Al99.85MgSi.

It is essential that the anodized components, especially trim parts, in the delivered state are free from polishing defects, scratches, damages or similar defects that may deteriorate the appearance of the components, especially trim parts.

In addition, the surface of the component must not exhibit any dulling, cloudiness, optical changes (for example, blue tinge), cracking or shadow-like regions, even in a state of use.

Before the treatment or coating, it must be ensured that the components are free from dust, fingerprints and other residues. The components must not be touched with bare hands before the treatment or coating. Any loading of product holders should be done with gloves of lint-free cloth.

Preferably, as usual in the prior art, the components are first degreased, subjected to preliminary and final chemical polishing steps, and deoxidized before the usual anodizing process is performed, for example, in sulfuric acid with direct current or alternate current.

Naturally, the aluminum component is rinsed, or spray-rinsed, between the respective steps.

Suitable methods and specifications for hard anodization can be found, for example, in *Aluminium Taschenbuch,* 16th Edition, 2009, pp. 577 ff. In particular, methods using direct current and sulfuric acid according to the so-called sulfuric acid anodizing method are described therein. This disclosure is fully included in the present invention by reference.

The sealing of anodically produced oxide layers is known from pp. 579 ff. of the above mentioned *Aluminium Taschenbuch*. It is described that the anodically produced oxide layer is microporous and reaches its optimal corrosion resistance only by a sealing treatment, which causes the pores to be closed. For this essential pore closure, two basic treatment methods are available, i.e., conventional (hydrothermal) sealing and cold impregnation on the basis of nickel fluoride (cold sealing).

The cold sealing is performed, for example, in a bath of fully desalted water adding a sealant containing a metal fluoride, for example, nickel fluoride and/or sodium fluoride, at a temperature above room temperature (25° C.), for example, at 28° C. to 32° C., and at a slightly acidic to neutral pH value, for example, from 6.0 to 7.0, for a few minutes, for example, at least 4 minutes, as described in WO 2009/068168 A1.

However, the process according to the invention can also be performed without this cold sealing step, so that both variants are equally preferred.

According to the invention, hot sealing is employed. The *Aluminium Taschenbuch* describes on page 580 that the conventional sealing by hydrating the oxide layer is as old as the method of anodic oxidation itself. The oxide layer produced is preferably subjected to a hot water treatment in fully desalted water with a pH value of 6+/−0.5 at more than 96° C., or to a treatment with saturated steam of above 98° C. According to this, the treatment time is usually 3 to 4 min/μm of layer thickness. The oxide layer is superficially dissolved during the sealing process. Any adsorbed anions from the anodizing bath are dissolved thereby. Because of the increase in pH value that takes place, aluminum hydroxide gel deposits on the surface, where it crystallizes. A conversion of the oxide to boehmite takes place in this process.

According to the invention, this process step of hot sealing is particularly important. Here too, hot sealing is preferably performed in the above mentioned temperature frame, but a significantly shorter sealing time is realized according to the invention. It is particularly preferred according to the present invention to perform the partial hot sealing in water at a temperature of more than 96° C., especially at up to 100° C., in the course of up to 30 s/μm, especially up to 20 s/μm, of layer thickness of the conversion layer. At this time, the pores of the anodized surface are not yet completely closed and can partially take up in the surface the material containing the organosilicon network former. This causes an excellent anchoring of this material in and on the conversion layer including the advantageous properties described above.

As set forth above, the pretreatment of the process according to the invention includes, in particular, degreasing, rinsing, pickling, rinsing, polishing, rinsing, acid treatment and rinsing, before the actual anodic oxidation.

Then, after the anodic oxidation and the hot sealing, the material containing the organosilicon network former is contacted with the anodically oxidized surface. This may be done, for example, by flow coating, dipping, spraying, rolling, knife coating and/or roller coating. It is also possible to charge the material and/or the substrate electrostatically before and/or during the contacting.

According to the invention, a material containing an organosilicon network former is employed. It may preferably be selected from the group of non-fluorinated silanes, especially $CH_3Si(OC_2H_5)_3$, $C_2H_5Si(OC_2H_5)_3$, $CH_3Si(OCH_3)_3$, $C_6H_5Si(OCH_3)_3$, $C_6H_5Si(OC_2H_5)_3$, $CH_2{=}CHSi(OOCCH_3)_3$, $CH_2{=}CHSi(OCH_3)_3$, $CH_2{=}CHSi(OC_2H_5)_3$, $CH_2{=}CHSi(OC_2H_4OCH_3)_3$, $CH_2{=}CHCH_2Si(OCH_3)_3$, $CH_2{=}CHCH_2Si(OC_2H_5)_3$, $CH_2{=}CHCH_2Si(OOCCH_3)_3$, $CH_2{=}C(CH_3)COOC_3H_7Si(OCH_3)_3$, $CH_2{=}C(CH_3)COOC_3H_7Si(OC_2H_5)_3$, $(C_2H_5O)_3SiC_6H_4NH_2$, $(C_2H_5O)_3SiC_3H_6NH^2$, $(C_2H_5O)_3SiC_3H_6CN$, $(CH_3O)_3SiC_4H_8SH$, $(CH_3O)_3SiC_6H_{12}SH$, $(CH_3O)_3SiC_3H_6SH$, $(C_2H_5O)_3SiC_3H_6SH$, $(CH_3O)_3SiC_3H_6NHC_2H_4NH_2$, $(CH_3O)_3SiC_3H_6NHC_2H_4NH_2$,

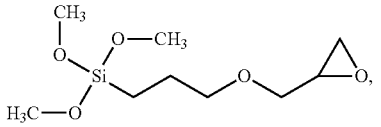

-continued

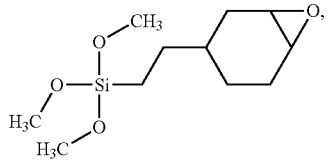

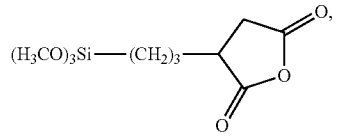

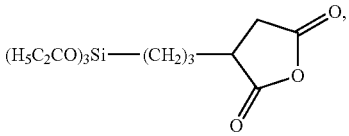

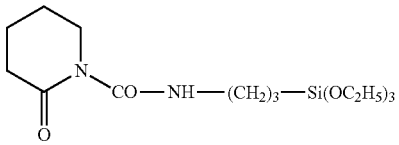

Alternatively or cumulatively, fluorinated silanes, especially $CF_3CH_2CH_2SiY_3$, $C_2F_5CH_2CH_2SiY_3$, $C_4F_9CH_2CH_2SiY_3$, n-$C_6F_{13}CH_2CH_2SiY_3$, n-$C_8F_{17}CH_2CH_2SiY_3$, n-$C_{10}F_{21}CH_2CH_2SiY_3$, where Y represents $OCH_3$ and/or $OC_2H_5$, may also be employed in the same way. The material as defined herein is preferably employed with a low solvent content, especially free from solvent. However, if appropriate, the material may also contain solvents or dispersants. According to the invention, the above mentioned silanes are cross-linked on the partially sealed conversion layer by a sol-gel process. This material has no thermoplastic properties during and after the sol-gel process, even if the sol-gel process was started before the contacting.

It is particularly preferred according to the present invention to perform the curing of the material containing an organosilicon network former at an aluminum-protecting temperature within a range of from 120 to 250° C., especially to 200° C. The sol-gel process causes an excellent curing that brings about the above mentioned properties, although the coating is extraordinarily thin and has a layer thickness as low as in the nanometer range, but also up to a few micrometers. Because of the incomplete closure of the pores, the uncured material permeates into the conversion layer and is also chemically bonded to it. In this process step, the conversion layer is further densified.

In contrast, what is much thicker is the anodically produced conversion layer itself, whose layer thickness is preferably from 5 to 15 μm, more preferably from 7 to 10 μm. Because of the extraordinarily low thickness of the cured material containing an organosilicon network former on and in the surface of the conversion layer, it contains Al—O—Si-bonded organosilicon-functional silicates. Thus, the above mentioned material is chemically bonded in and to the conversion layer and thus leads to an extraordinarily high adhesive strength of the latter, which naturally does not have any thermoplastic properties.

The term "aluminum surface" within the meaning of the present invention includes any aluminum substrates, for example, the alloys described in EP 1 780 313 A2 in [0009] as well as the pure metal. The aluminum surfaces obtainable according to the invention may naturally have a colorless and/or colored surface. In a case where the surface should be colored, this can be integrated into the anodizing process or into the coating process in accordance with the process usual in the prior art.

The anodically oxidized surfaces obtainable according to the invention may occur in a wide variety of forms, for example, in the form of façades, window frames, door frames, fitting parts and trim strips in construction, in vehicle construction and in the furniture industry, rims, household appliances, signs, lighting elements, furniture components, machine elements, handles, construction parts, fixtures or engine components and heat exchangers, for example, for air conditioning systems in vehicles or buildings. The components according to the invention may also be employed in the field of medical engineering, in which disinfecting methods are frequently employed. These components meet the manufacturer's specifications if they are treated, for example, with ozone, steam or hydrogen peroxide.

EXAMPLE

Example 1

An aluminum component of Al99.85MgSi anodized according to the prior art (*Aluminium Taschenbuch* loc. cit.) and initially sealed (partially sealed) for 30 seconds in hot water of >96° C. was stored under a standard laboratory atmosphere for another 24 hours after rinsing and drying. A conversion layer having a thickness of 7.5 μm was obtained.

Thereafter, this partially sealed component was dipped into a composition of 58.80 g of tetraethoxy orthosilicate, 24.90 g of [3-(2,3-epoxypropoxy)propyl]trimethoxysilane, 25.17 g of fully desalted water and 2.13 g of 32% hydrochloric acid, which had been diluted with a mixture of 184.53 g of 2-propanol and 3.72 g of fully desalted water, and withdrawn so slowly that a visible wet film remained recognizable on the component during the withdrawal. After an air drying time of 10 minutes, the component was heated in a convection oven at 200° C. for one hour, and the anodized layer added with silicate was finally sealed and cured.

The total layer thickness of the conversion layer including the silicate layer was about 8.5 μm.

Example 2

An aluminum component of Al99.85MgSi anodized according to the prior art (Aluminium Taschenbuch loc. cit.) with a conversion layer having a thickness of 7.5 μm was partially sealed in hot water of >96° C. for 3 minutes (24 seconds/μm of conversion layer). After rinsing and drying, the component was stored under a standard laboratory atmosphere for another 24 hours.

Thereafter, this partially sealed component was dipped into a composition of 58.80 g of tetraethoxy orthosilicate, 24.90 g of [3-(2,3-epoxypropoxy)propyl]trimethoxysilane, 25.17 g of fully desalted water and 2.13 g of 32% hydrochloric acid, which had been diluted with a mixture of 184.53 g of 2-propanol and 3.72 g of fully desalted water, and withdrawn so slowly that a visible wet film remained recognizable on the component during the withdrawal. After an air drying time of 10 minutes, the component was heated in a convection oven at 200° C. for one hour, and the anodized layer added with silicate was finally sealed and cured. The total layer thickness of the conversion layer including the silicate layer was about 8.5 μm.

A component treated according to Example 1 or 2 passed the following test:

The testing was done at a temperature of 23° C. The subsequent tests were performed successively on the same component in the order given.

Sequence: dipping in solution of pH 1 for 10 min; rinsing in fully desalted water and drying, heat storage for 1 h at 40° C. (further test sequence without cooling), dipping in solution of pH 13.5 for 10 min; rinsing in fully desalted water and drying.

No optical change from the original state could be seen.

Test solution defined by calculation:

pH 1: 0.1 M aqueous hydrochloric acid pH 13.5: buffer solution of 12.7 g of sodium hydroxide, 4.64 g of sodium phosphate dodecahydrate (corresponding to 2 g of sodium phosphate), 0.33 g of sodium chloride (corresponding to 200 mg of chloride), dissolved in 1 liter of water.

Comparative Example 1

An aluminum component of Al99.85MgSi anodized according to the prior art (Aluminium Taschenbuch loc. cit.) with a conversion layer having a thickness of 7.5 μm was sealed in hot water of >96° C. for 30 minutes. After rinsing and drying, the component was stored under a standard laboratory atmosphere for another 24 hours.

Thereafter, this sealed component was dipped into a composition of 58.80 g of tetraethoxy orthosilicate, 24.90 g of [3-(2,3-epoxypropoxy)propyl]trimethoxysilane, 25.17 g of fully desalted water and 2.13 g of 32% hydrochloric acid, which had been diluted with a mixture of 184.53 g of 2-propanol and 3.72 g of fully desalted water, and withdrawn so slowly that a visible wet film remained recognizable on the component during the withdrawal. After an air drying time of 10 minutes, the component was heated in a convection oven at 200° C. for one hour, and the anodized layer added with silicate was cured. The total layer thickness of the conversion layer including the silicate layer was about 8.5 μm.

A component treated in this way failed the testing according to the Examples. An optical change from the original state could be seen. The component had undergone discoloration to white.

Comparative Example 2

An aluminum component of Al99.85MgSi anodized according to the prior art (Aluminium Taschenbuch loc. cit.) with a conversion layer having a thickness of 7.5 μm was sealed in hot water of >96° C. for 15 minutes. After rinsing and drying, the component was stored under a standard laboratory atmosphere for another 24 hours.

Thereafter, this sealed component was dipped into a composition of 58.80 g of tetraethoxy orthosilicate, 24.90 g of [3-(2,3-epoxypropoxy)propyl]trimethoxysilane, 25.17 g of fully desalted water and 2.13 g of 32% hydrochloric acid, which had been diluted with a mixture of 184.53 g of 2-propanol and 3.72 g of fully desalted water, and withdrawn so slowly that a visible wet film remained recognizable on the component during the withdrawal. After an air drying time of 10 minutes, the component was heated in a convection oven at 200° C. for one hour, and the anodized layer added with silicate was cured. The total layer thickness of the conversion layer including the silicate layer was about 8.5 μm.

A component treated in this way failed the testing according to the Examples. An optical change from the original state could be seen. The component had undergone discoloration to white.

Comparative Example 3

An aluminum component of Al99.85MgSi anodized according to the prior art (Aluminium Taschenbuch loc. cit.) with a conversion layer having a thickness of 7.5 μm was not sealed. After rinsing and drying, the component was stored under a standard laboratory atmosphere for another 24 hours.

Thereafter, this component was dipped into a composition of 58.80 g of tetraethoxy orthosilicate, 24.90 g of [3-(2,3-epoxypropoxy)propyl]trimethoxysilane, 25.17 g of fully desalted water and 2.13 g of 32% hydrochloric acid, which had been diluted with a mixture of 4019 g of 2-propanol and 82 g of fully desalted water, and withdrawn so slowly that a visible wet film remained recognizable on the component during the withdrawal. After an air drying time of 10 minutes, the component was heated in a convection oven at 200° C. for one hour, and the anodized layer added with silicate was finally sealed and cured. The total layer thickness of the conversion layer including the silicate layer was less than 8.5 μm and was substantially the same as the original layer thickness.

A component treated in this way failed the testing according to Examples 1 and 2. An optical change from the original state could be seen. The component had undergone discoloration to white.

The invention claimed is:

1. A process for treating an anodically oxidized surface of aluminum or an aluminum alloy having a thickness of from 5 to 15 μm by means of a wet chemical process, wherein the surface of aluminum or of an aluminum alloy is pretreated, anodically oxidized, rinsed and partially hot-sealed in fully desalted water with a pH value of 6+/−0.5 or to a treatment with saturated steam above 98° C., thus forming a conversion layer comprising AlO(OH) on said pretreated, anodically oxidized, rinsed and partially hot-sealed surface of aluminum or aluminum alloy, said conversion layer having pores that are not completely closed characterized in that partial hot sealing is performed in a solution consisting of fully desalted water at a temperature greater than 96° C. up to 100° C. or to a treatment with saturated steam above 98° C. in the course of up to 30 s/μm of layer thickness of the conversion layer, followed by contacting the conversion layer with a material containing an organosilicon network former, thus completely closing said pores, followed by curing at a temperature of up to 250° C. resulting in a colorless aluminum surface containing Al—O—Si bonded organosilicon functional silicates, wherein the Al—O—Si bonds are in and on the conversion coating, and exhibiting alkali resistance up to pH values of 13.5.

2. The process according to claim 1, characterized in that said pretreatment includes degreasing, rinsing, pickling, rinsing, polishing, rinsing, acid treatment, and rinsing.

3. The process according to claim 1, characterized in that said material is contacted with said anodically oxidized surface by flow coating, dipping, spraying, rolling, knife coating and/or roller coating.

4. The process according to claim 1, characterized in that the material and/or the conversion layer is charged electrostatically before and/or during the contacting.

5. The process according to claim 1, characterized in that said partial hot sealing is performed in the course of up to 20 s/μm of layer thickness of the conversion layer.

6. The process according to claim 1, characterized in that a material is employed that contains one or more organically modified silanes selected from the group of non-fluorinated silanes, selected from $CH_3Si(OC_2H_5)_3$, $C_2H_5Si(OC_2H_5)_3$, $CH_3Si(OCH_3)_3$, $C_6H_5Si(OCH_3)_3$, $C_6H_5Si(OC_2H_5)_3$, $CH_2{=}CHSi(OOCCH_3)_3$, $CH_2{=}CHSi(OCH_3)_3$, $CH_2CHSi(OC_2H_5)_3$, $CH_2{=}CHSi(OC_2H_4OCH_3)_3$, $CH_2{=}CHCH_2Si(OCH_3)_3$, $CH_2CHCH_2Si(OC_2H_5)_3$, $CH_2{=}CHCH_2Si(OOCCH_3)_3$, $CH_2{=}C(CH_3)COOC_3H_7Si(OCH_3)_3$, $CH_2{=}C(CH_3)COOC_3H_7Si(OC_2H_5)_3$, $(C_2H_{50})_3SiC_6H_4NH_2$, $(C_2H_5O)_3SiC_3H_6NH_2$, $(C_2H_5O)_3SiC_3H_6CN$, $(CH_3O)_3SiC_4H_8SH$, $(CH_3O)_3SiC_6H_{12}SH$, $(CH_3O)_3SiC_3H_6SH$, $(C_2H_5O)_3SiC_3H_6SH$, $(CH_3O)_3SiC_3H_6NHC_2H_4NH_2$, $(CH_3O)_3SiC_3H_6NHC_2H_4NHC_2H_4NH_2$,

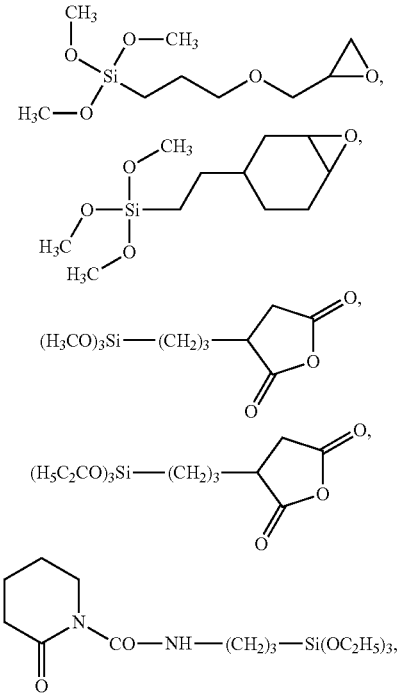

and/or fluorinated silanes, selected from $CF_3CH_2CH_2SiY_3$, $C_2F_5CH_2CH_2SiY_3$, $C_4F_9CH_2CH_2SiY_3$, n-$C_6F_{13}CH_2CH_2SiY_3$, n-$C_8F_{17}CH_2CH_2SiY_3$, n-$C_{10}F_{21}CH_2CH_2SiY_3$, where Y represents $OCH_3$ and/or $OC_2H_5$.

7. The process according to claim 1, characterized in that said curing is performed at a temperature within a range of from 120 to 200° C.

8. The process of claim 1, wherein said partial hot sealing is performed in a solution consisting of fully desalted water at a temperature greater than 96° C. up to 100° C. for up to 20 s/μm.

* * * * *

UNITED STATES PATENT AND TRADEMARK OFFICE

CERTIFICATE OF CORRECTION

PATENT NO. : 10,385,470 B2
APPLICATION NO. : 14/386686
DATED : August 20, 2019
INVENTOR(S) : Danzebrink et al.

It is certified that error appears in the above-identified patent and that said Letters Patent is hereby corrected as shown below:

On the Title Page

Column 1 (30) Foreign Application Priority Data:
Change "Mar. 22, 2012 (DE) ..... 10 2012 204 636" to
Mar. 22, 2012 (DE) ..... 10 2012 204 636.4

Signed and Sealed this
Eighth Day of October, 2019

Andrei Iancu

Andrei Iancu
*Director of the United States Patent and Trademark Office*